US005440977A

United States Patent [19]

Poutanen

[11] Patent Number: 5,440,977

[45] Date of Patent: Aug. 15, 1995

[54] METHOD FOR PRODUCTION OF TRUSSED RAFTERS WITH NAIL PLATE JOINTS

[76] Inventor: Tuomo T. Poutanen, Tapulinkatu 46 C, SF-33400 Tampere, Finland

[21] Appl. No.: 117,132

[22] PCT Filed: Apr. 9, 1991

[86] PCT No.: PCT/FI91/00104

§ 371 Date: Sep. 14, 1993

§ 102(e) Date: Sep. 14, 1993

[87] PCT Pub. No.: WO92/18719

PCT Pub. Date: Oct. 29, 1992

[51] Int. Cl.[6] ..... B30B 13/00

[52] U.S. Cl. ..... 100/39; 29/432; 29/798; 52/DIG. 6; 100/913; 144/345; 144/353; 227/152

[58] Field of Search ..... 100/35, 41, 39, 913, 100/137, 155 R, 161, 173, 193, 231; 29/432, 798; 227/152; 144/345, 353; 52/DIG. 6, 693–695

[56] References Cited

U.S. PATENT DOCUMENTS

| | | | |
|---|---|---|---|
| 3,304,106 | 2/1967 | McCormack | 100/913 X |
| 3,435,508 | 4/1969 | Sanford | 29/432 |
| 3,439,607 | 4/1969 | Sanford | 100/913 X |
| 3,530,790 | 9/1970 | Post | 100/100 |
| 3,599,562 | 8/1971 | Hutchens, Sr. | 100/100 |
| 3,685,129 | 8/1972 | Jureit et al. | 29/432 X |
| 3,771,439 | 11/1973 | Mort | 100/100 |
| 3,867,803 | 2/1975 | Platt | 52/693 |
| 3,888,169 | 6/1975 | McNaughton | 100/913 |
| 4,005,520 | 2/1977 | Sanford | 29/432 |
| 4,071,061 | 1/1978 | Schneider | 100/913 X |
| 4,104,962 | 8/1978 | Castillo | 100/913 X |
| 4,252,058 | 2/1981 | Tison | 100/913 |
| 4,414,787 | 11/1983 | Kappen | 52/643 |
| 4,514,899 | 5/1985 | Burger | 100/913 |
| 4,653,242 | 3/1987 | Ezard | 52/DIG. 6 |
| 4,738,071 | 4/1988 | Ezard | 52/DIG. 6 |
| 5,234,279 | 8/1993 | Poutanen | 52/DIG. 6 |

FOREIGN PATENT DOCUMENTS 291878 1/1966 Australia .

*Primary Examiner*—Stephen F. Gerrity
*Attorney, Agent, or Firm*—Larson and Taylor

[57] ABSTRACT

A method for production of a trussed rafter, wherein the nail plates are affixed to timber members in conjunction with cutting of the timber members and before they are transported to an assembly station. The assembly station can be any type of a rafter jig but can also be a levelled surface, e.g., a factory floor, thereby eliminating the need for an assembly jig. The labor and force required in timber member jointing are substantially reduced, because the nail plates are already affixed to the timber members and assembly can be largely limited to affixing of upper nail plates (8). The assembly surface has a grid pattern (1) thereon, enabling the positioning of side quides (2) required for assembling. Markings indicating prefixed platings and/or nail plates positions are used to provide quality control.

17 Claims, 1 Drawing Sheet

METHOD FOR PRODUCTION OF TRUSSED RAFTERS WITH NAIL PLATE JOINTS

BACKGROUND OF THE INVENTION

1. Field of the Invention

This invention relates to the production of a trussed rafter with nail plate connections.

2. Description of the Prior Art

Trussed rafters of timber members and nail plates are today produced as follows: the timber members are cut by length and at specific angles with special saws. These saws generally have four blades and the timber moves transversely with respect to the saw. The timber members are assembled in a special jig fixed according to rafter measurements and nail plates are manually positioned in the joints of the jig. The nail plates are pressed into the timber by means of clamping arrangements and a press in the jig. In the jig, the plates can be only pressed to half the full depth, whereby the final pressing takes place usually in a finalizing roller. The jig can also be of such a construction that the nail plates are fixed and pressed first on the one side and then the rafter is turned around, i.e., turned over, and the plates of the other side are fixed so that fixing of plates underneath the timber members is not necessary.

There are a lot of problems with the presently used trussed rafter production methods as follows:

a) In all trussed rafter jigs, nail plates are fixed manually, so that the possibility of errors is remarkable, on the order of even up to 10 to 20 mm. These errors must be taken into account by making the plate bigger, which means a substantial increase of nail plate costs. Even though the plate size is made bigger, the final result is still unreliable, since an error in plate positioning is difficult to detect and control.

b) The rafter assembly jig is expensive. If the plate is pressed by the direct method, i.e., usually by using a beam press or a C-press, the jig and the pressing element must be robust because of the great pressing force extended on the nail plate. If pressing is done by the roller method, measuring is largely carried out by a prefixing jig station and the final-fixing roller for the plates, as well as the conveyors between them, are expensive equipment. If the production is based on turning the trussed rafter, two separate jigs and plate positioning stages are needed, which makes the method complicated and for this reason, the method is not frequently applied.

c) On starting the production of a trussed rafter batch, the jig must be installed, a form exactly similar to the trussed rafter found, and the positions of joints and plates determined. This is usually done by manual measuring, which is a time-consuming job. For jig setting, there are also many kinds of automatic measuring units and purely data controlled jigs have also been developed. However, jigs of this kind are expensive and generally applicable only to the production of standard type trussed rafters or the jigs do not carry out the setting completely but often many manual operations are still required, e.g., positioning of joints and plates must still be determined.

d) The percentage of waste in production of trussed rafter timber members is remarkable, being on the order of 5% of all timber. This is mainly due to two reasons: firstly, cutting is usually done by four blade saws which always means some waste, because almost in every case a small bit has to be sawn off for timber member head formation, and secondly, the timber member length very seldom corresponds to the length of timber members to be sawn but is usually somewhat longer. This results in waste pieces that can not be used in the production.

e) It is difficult to integrate the trussed rafter timber handling with automatic stress grading. This is due to the fact that in stress grading timber members move lengthwise and thus four blade cutting and stress grading cannot be combined economically. Present cutting saws are manual and it has not been possible to combine such saws with stress grading due to the slow movement thereof.

f) Both manual and mechanical quality and stress grading methods presently used are inherently very uneconomical. Since the grading is based on the principle that in the design for each timber member the greatest stress is determined and, accordingly, the strength requirement for this timber member is set using the principle that the weakest stress point must correspond at least to the greatest stress. Timber strength is determined by defect, i.e., by the weakest point, and this strength is almost always quite small with respect to that of the overall timber member. It is typical that in a trussed rafter the stress is also very small, because in the trussed rafter dimensioning, the stress is a peak type moment load. Since there is very little probability that the decisive stress and the decisive defect or weakness will actually coincide, very high standards are set for timber quality in present methods. The effect of this fact is rather great in trussed rafters with dominating peak-type stress (in contrast to other constructions , e.g., beams and pillars). This is of great importance, because the timber itself is the biggest cost item in trussed rafter production.

A basically similar requirement of excessively high quality timber is related to timber wane and to the fact that such wane cannot be allowed in joints under the nail plate. Trussed rafter timber members could have substantial wane outside the joint area without any practical harm but this is not possible with present production methods which require full-edged timber.

DESCRIPTION OF THE INVENTION

By virtue of this invention, all of the above mentioned disadvantages can be eliminated or reduced to a great extent and, furthermore, advantages are gained which are not possible with the prior art.

According to one aspect of the invention, the nail plates are prefixed to timber members before the timber members are brought to the trussed rafter assembly station. Generally, the plates are prepressed most advantageously underneath the chord beams and on the upper surface of diagonals and verticals. Alternatively, a part of the plates, especially the upper ones, can be positioned only at the assembly station. The nail plates can be pressed in an assembly device especially constructed for this purpose but it is most advantageous to provide plate fixing (or at least plate marking) in connection with timber member cutting. This is very easy and economical if cutting of timber members takes place in a single-line with timber moving lengthwise. Fixing nail plates to timber members is known per se but in the presently used production methods this is done inaccurately by hand only at the assembly station by turning the chord beam around (over). With this approach, it has been possible, in any case, to fix the plate to the upper side or so that the nail plate on the underside has been fixed lightly with a hammer or a corresponding tool to the diagonals and verticals, thus avoiding fixing of the underside plate in the jig.

A new feature of the present invention is that plate fixing is accurate and the underneath plates are fixed, at least for the most part, to the chord beams. Most advantageously, all nail plates are fixed to the timber members in the plate assembly device before they are brought to the assembly station or device. In such an assembly device, the plates can be fixed with reliable accuracy, quickly, mechanically and automatically. Essential is also that the plate is so fixed that the teeth penetrate into the timber over its whole length or mostly over its whole length, whereby joint connections at the assembly station can be minor and the required force minimal.

In practice of the invention, an assembly jig is not needed at all, and timber members of trussed rafters can be simply prefixed at the assembly station, which can be a levelled surface, e.g., a factory floor. However, a metal or a wood surface is preferable thereby allowing fixing of side guides or some other arrangement and, furthermore, making it possible to use lifting and conveying devices. According to the trussed rafter form, side guides are fixed to the floor with nails, screws or the like to form, in a way, a simple "jig" i.e., an assembly station, and to steer or guide the chord beams into position. However, an assembly station of this construction is not a "rafter jig" as the term is presently used, since there are not necessarily any permanent devices at an assembly station, which would disturb or impede any other use of this space, and therefore, the assembly station can at any time be used as storage space, for traffic and so on. This very significantly increases the applicability of this space.

When the chord beams have been assembled, the diagonals and verticals can be placed inside of them. Thereby, measurements are not necessarily needed, because the nail plates in the rafter beams guide or steer the diagonals and verticals to the right positions or places. In such a rafter assembly it is advantageous to apply a method wherein the diagonals and verticals are tightened against the chord beams, so that there must be at least in one joint a gap for tightening and accommodating any inaccuracy of measurement. Joints of this kind can be easily made with nail plates described in the PCT patent publication No. FI89/00168.

In trussed rafter production according to the invention, handling of timber members and plates is typically automatic or semi-automatic, and the assembly manual. Even though the assembly of timber members is manual and, in addition, with respect to work ergonomy, seemingly disadvantageous, the method is still a good one both with respect to workmanship and work ergonomy, because the assembly of timber members and joint and plate position measurements can be accomplished without the need for squatting, and the assembly is fast, since on the one hand, there is enough clearance between the timber members and, on the other hand, the timber members are efficiently guided or steered to right position.

In a production line according to the invention, the use of roller fixing is advantageous. Prefixing is thus especially easy, because nail plates are pressed into timber to only half the depth of the plate teeth. Prefixing is an easy job and can be simply carried out with a rod, a pneumatic or hydraulic hammer, roller or the like which means that no heavy fixing tools are needed. Theoretically, fixing using the method of the invention takes approximately 50% of the workmanship needed in presently used methods, because half of the nail plate areas are prefixed.

In practice, the fixing required is lesser still, because only the upper plate has to be fixed to the rafter during the assembling. The workmanship and force needed in this job are only a fraction of the present methods especially when also the upper plates are prefixed and the timber members are prefixed on the floor and the final fixing is made in the next stage of production.

Because of the method of the invention, the plates can also be fixed to their full depth at the assembly station, especially when the trussed rafter is a small one and the nail plates are also small. This method is most applicable when fixing of plates is carried out with some kind of hammering tool.

In carrying out or setting the rafter measurements and defining the side guides positions, a grid or mesh pattern on the floor can be used, which makes the setting very fast as the required grid measurements are shown in the drawings. It takes only a few minutes for one man to fix the side guides, whereas present manual jigs take 30 to 60 minutes and even the automatic jigs take approximately 5 minutes and the grid pattern can be vertical and also horizontal at the same time. Because in this method measuring of the joint positions and plate positions is not needed at the assembly station, the overall setting time of the method of the invention is only a fraction of the present methods with respect to total workmanship and total working time.

At the assembly station, plate handling is not necessarily needed at all, because the nail plates are already fixed to timber members. This results in very substantial time-savings not only in setting time but also in production itself, since fixing of a nail plate, especially underneath timber members, is difficult and time consuming with all present manual and automatic assembly jigs. In the production method according to the invention, the need for labor is reduced while the working process is faster in the actual production in addition to the initial setting.

When the underneath and upper nail plates are prefixed to every joint, the fixings are completely independent from each other, but in the final product the plates in the joints must coincide. If this is not the case, it will be due to some error that is easy to detect. Therefore, the production method of the invention offers an easy and advantageous way to check the accuracy of plate positioning. This fact is of great practical importance in this invention. Even though the nail plates are fixed only on one side, preferably underneath, it is still possible to provide accurate checking of the positioning the timber members. In fact, the timber members are precut and generally only fit in a trussed rafter in one way. The heads of the diagonals and verticals must match with the nail plates, so that an approximate check on the accuracy of the nail plate positions and timber members is achieved.

If the nail plates are fixed on both sides of the timber members (generally, on the one side of the chord beams and on the diagonals and the verticals), a triple checking of the accuracy of nail plate positioning and the overall trussed rafter is possible by checking the following: (1) overlapping of plates; (2) matching of timber members; and (3) coincidence of timber member heads with nail plates. The last mentioned check is most applicable and reliable if the joints are so formed that the plates are placed, at least to some part, in the joint using as reference the timber member corners. This kind of method is described in the PCT publication No. FI89/00168.

Today, cutting of timber members is usually carried out with a standard four blade saw where timber moves transversely through the saw. If cutting is done with a cutting saw, timber moves lengthwise in the same way as in a finger joint line, a nail plate splicing machine and a stress grading machine. When the sawing process, wherein cutting of timber members, finger jointing and/or possibly overall nail plate splicing as well as nail plate prefixing, are carried out in one line, a overall arrangement is achieved which can be automated advantageously. This is mainly based on two facts. First, due to the inherent or natural inaccuracy of timber, variations in cross section measurements, crookedness and the like, it is difficult to grip the timber accurately. By combining these various steps, the error due to gripping is diminished since the timber member gets its shape or form by the first gripping and cutting and, in this respect, the plates can be fixed with accuracy without any gripping error. In the latter regard, accurate gripping can easily be shifted over from one working stage to another, e.g. from cutting to plate fixing, and second, all stations can be controlled by the same automation, i.e., by a single central automatic control unit, which simplifies the process and reduces risk of error.

Cutting of timber members with two cuts in the end or head is slow with a cutting saw. A considerably more advantageous application of the invention is where the joint can be so made at both timber ends that there is only one cut at least in the timber members which are furnished with nail plates and this can be made in the same line with an ordinary cutting saw. This is a rather easy procedure, because the timber members of chord beams have almost always one cut and it is possible to design the diagonals and verticals so that approximately half have one cut and have the nail plates fixed to them, while the other half of the verticals and diagonals are without nail plates and can be cut with any method, e.g., with a four blade saw.

Perpendicular cuts are easily made with cutting saws. Accordingly, the joint can be so made such that in cuttings with two cuts, one of the cuts is always perpendicular. The joints are then so formed that even relatively large gaps are provided, although such joints are not permitted according to present regulations. It is, however, possible to make a nail plate and a nail plate joint with big gaps. This procedure has many advantages as follows: (a) the total length of timber members can be less than in present trussed rafters and production methods, (i.e. the total length of timber members is less than the theoretical length calculated from the physical total lengths and so the present production method results in "negative waste,"i.e., a savings of timber); (b) cutting of all timber members is easily carried out with a Cutting saw; and (c) the timber inventory can be comprised of precut and possibly also stress-graded planks. When this timber inventory is automated in the same manner as present inventories, a remarkable increase in speed of operations and in material saving is obtained. For each unit such a timber member can be selected as required and unnecessary waste of timber member stress reserves is avoided. The timber members can be automatically picked-up for production which is of great importance when rafter batch size is small.

Generally, in presently used trussed rafters all diagonals and verticals are straight but in certain cases, usually only in bottom chord, a camber is made. In general, curved beams and cambers are not amenable to present rafter production methods or such methods cannot be used at all. However, an upward curvature similar to camber would be most advantageous in the top chord, because the top chord has a much bigger load than the bottom chord and also because the top chord is in any event more heavily loaded, e.g., due to the risk of buckling. Curving can be done for aesthetic reasons, and in such instances, can also be directed downwardly. By making use of the grid or pattern referred to above, it is very easy to make all rafter diagonals and verticals, especially the rafter chord beams extending upwardly or downwardly. Forcing the chord beams into a curvature can simply be carried out by means of diagonals and verticals and/or wedges or the like fixed to the assembly floor. Because of the easy handling of curved members, in addition to the advantages of setting and production described above, the method of invention makes it possible to produce trussed rafters which cannot be made with present methods.

If the beams are curved, it is of great advantage that there be only a small variation in the joints, because even the smallest error in a curved beam can be a serious disadvantage. There is little variation in stiff joints and, in any case, these kinds of joints are advantageous with respect to stress distribution. A means to make stiff joints is described in the above mentioned PCT patent publication No. FI89/00168 and producing a joint like this by means of the present invention is quite easy, e.g., because of the slight variation in plate positioning. It is also very demanding to make curved beams because of the difficult positioning of joints and plates. In the method according to the invention, measuring and its control is easy and reliable and, accordingly, the method is also in this respect fully applicable to the production of trussed rafters wherein at least some of the members are curved.

The production of timber members according to the invention is most advantageous in connection with a production line wherein the timber moves lengthwise. Splicing of timber members is then easy either with a finger splicing method or with nail plate splicing or the like. The advantage of this kind of timber member splicing resides in the fact that timber waste is practically totally eliminated. In the practice, no timber splices are not so strong as the timber itself, and therefore it is important to put the splice in such a place where the stresses are not greater than allowed for the splice. When such a line is automated, it is easy to check the joint positions without resorting to any special measures.

In a simplified application of the invention, the nail plate positions are marked in the timber members at the above mentioned cutting station and/or in still more simplified application, in a special device for measuring and marking of plate positions and cutting locations. Such a nail plate position can be painted or only marked using a light ray or the like directed onto the timber members, e.g., so that the timber member is marked with the positions of the nail plate edges or only the corners, and, if possible, also with the plate size. Such a line can be easily put into practice in that handling of nail plates is eliminated.

In the same simple line or in a more sophisticated line, other rafter codes can also be marked in timber members, such as the location of support, buckling support required, date of production, the code of rafter load, spacing of battens, the location of a secondary construction to be fixed in the rafter, e.g., hip roof eave beam or inclined eave beam, customer data, site address, handling instructions, and critical area regarding rafter strength.

Today, many of these markings are written in the rafter or marked by stamping or stickers. Marking provided using the present invention is much faster. Further, there can be many markings and they can differ between rafters and rafter members. In accordance with this invention, there is non-manual data transmission between trussed rafter design and the station for marking and cutting and, therefore, different markings containing large amounts of information can be made with very small extra cost and labor.

In applying the marking technique of the preceding paragraph, further to the marking of the timber strength, a new procedure for stress grading in rafters is obtained by the method of the invention. The utilization of stress graded timber is based today on the following principle: the minimum strength of timber is determined by design and fulfillment of the same by grading, and this means that first comes the design and then the timber or required strength is selected from the timber inventory. In this invention, this procedure could be carried out as follows: by the design the spots in the timber which require special strength are defined, and then checked in production, i.e., the design comes first and then ungraded (or only rough graded) timber is selected, whereupon it is determined if the timber for the rafter is to be rejected or not on the basis of the strength markings, of any joints or for other reasons. This procedure is much cheaper because of simpler machines and because of the method of the invention, the demand of high quality timber is reduced, since in a very small part of the timber, strength (or full edge) is required. This method is very practical in trussed rafters with varying stress and dimensioning often according to stress peaks. Accordingly, the method of the invention is applicable as the only stress grading method and is also especially well suitable also for adjustment of mechanical stress grading methods, because presently used stress grading machines cannot detect timber defects.

BRIEF DESCRIPTION OF THE DRAWINGS

The invention is illustrated in FIGS. 1, 2, and 3, wherein.

Description of the Preferred Embodiments

Figure 1:
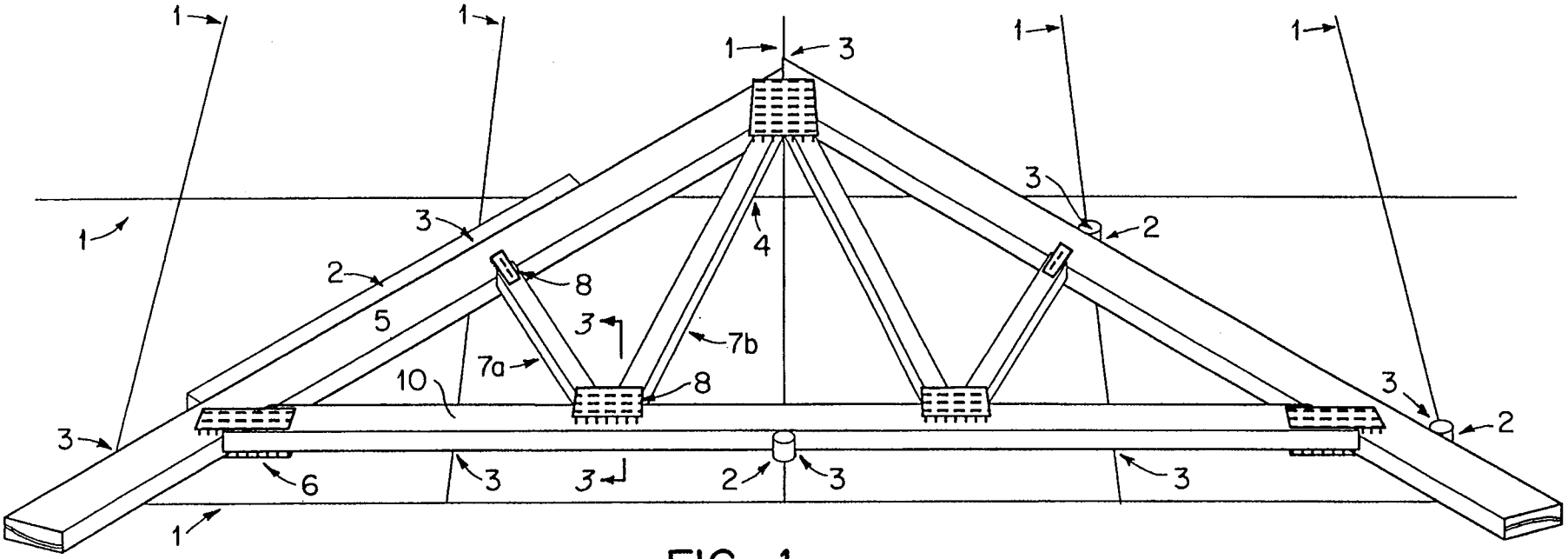
FIG. 1 is a perspective view of trussed rafter production with timber members assembled on the assembly surface.

FIG. 1 illustrates an assembly of (W-type) trussed rafter on the assembly surface, e.g. factory floor. On the assembly surface there is a grid or mesh pattern for making measurements. This pattern of measuring lines may be vertical with 1 meter spacing and horizontal with 1 to 2 meter spacing, by means of which this pattern side guides or position guide elements 2 can be fixed, i.e., appropriately positioned, in that the rafter drawings show the grid or mesh pattern measurements 3 of the rafter outer dimensions. In addition, there can be other grid pattern measurements in the drawing, e.g., grid pattern measurements of the rafter diagonals 4. By means of these measurements (or measurement lines), the accuracy of the positions of diagonals and verticals can be checked as needed, e.g., when curved members are used, when there are gaps in joints and/or when a precise result is desired.

Nail plates indicated at 6 are pressed underneath the timber members 5 which form the rafter and further nail plates 8 are pressed into the upper side of diagonal 7*a*. At this stage of production, the diagonals and verticals are fixed into position. A check can be made to determine whether the lower and the upper plates are overlapping. Nail plates 8 are hammered or pressed so that the diagonals and verticals and the chord members are formed together mainly by the upper plates 8, whereafter the rafter is lifted from the assembly surface and conveyed, e.g., to a roller, where the plates are finally pressed together. The finalizing roller and the lifting and conveying equipment are not shown in the drawings, but these can be provided by conventional means. Alternatively, especially in case of small size trussed rafters, the plates can be pressed or hammered to their full depth, whereby no finalizing roller is needed. In both cases, the amount of fixing is reduced as compared to present methods and a fixing tool, e.g., a pneumatic hammer (operating on the same principle as a nail gun), a hydraulic hammer, a roller and the like can be used. This prefixing tool can be light and manually transportable and so floor-fixed or roof-fixed conveyors are not needed as in presently used methods.

Figure 2:
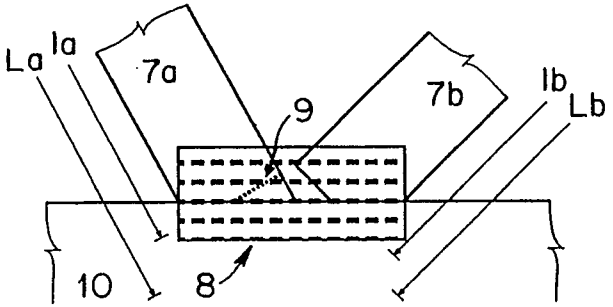
FIG. 2 is a nail plate joint employing timber members with two end cuttings, one of them perpendicular.

FIG. 2 shows an ordinary K-joint, wherein the end of one of the diagonals, diagonal 7*b*, has two cuts (one of them perpendicular to the longitudinal axis of the corresponding diagonal). In the illustrated embodiment, the other diagonal 7*a* is shown with one cut but this diagonal can also have two cuts (the second cut being indicated along the dotted line 9) so that one of the cuts is perpendicular. In both cases, the effective length of the diagonals is shown, i.e., the length required to make the diagonals in practice. It is assumed that cutting of diagonal 7*a* is done symmetrically, thus obtaining two similar diagonals. The effective member lengths produced by the present production method are indicated at 1*a* and 1*b*, and, correspondingly, the lengths L*a* and L*b* of the present method are also shown. The figure also shows that in both cases, a timber savings is achieved.

Figure 3:
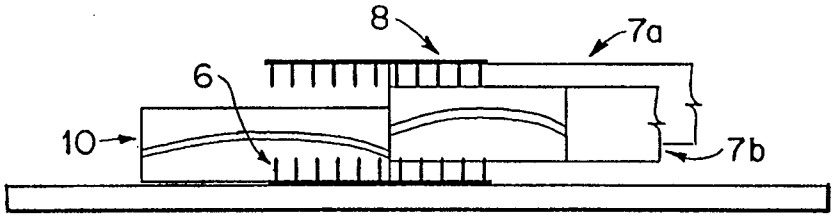
FIG. 3 is a cross-section of a rafter chord at a joint with the timber members assembled on the assembly surface and the diagonals and verticals and nail plates of the chords not yet fixed together.

FIG. 3 is the cross-section of a rafter joint with timber members assembled on an assembly surface. In this case the upper plate 8 is fixed to diagonal 7*a*. Generally, it is preferable to fix or press the plate into the diagonal with the greatest fixing area. On the other hand, it is advantageous to arrange the fixing at both diagonal heads, so that about half of the diagonals can be without nail plates. Both of these objectives can be reached simultaneously when the nail plates of the diagonals are fixed to the members with the greatest forces.

Further applications of this invention are self-evident in the light of the forgoing example.

I claim:

1. A method for the production of a trussed rafter from timber members using nail plates, said method comprising accurately affixing a plurality of the nail plates to the timber members prior to assembly of the timber members into the trussed rafter and at a station where cutting of the timber members takes place, said cutting and affixing including measuring of the timber members and gripping of the timber members, assemblying said members at an assembly station which is at a different station from said station wherein the affixing of said plurality of nail plates is performed by using measurements, made during said cutting and said affixing, which are based on uniform measuring and gripping of the timber members, whereby measurement errors caused by gripping of timber members of a non-standard shape are avoided.

2. A method as claimed in claim 1 wherein a marking device is used, during said affixing of the nail plates and said cutting of the timber members, to mark codes relating to the trussed rafter to be produced.

3. A method as claimed in claim 2 wherein said codes relate to the timber members used to produce the trussed rafter.

4. A method as claimed in claim 2 wherein said codes relate to a marking location on the timber members used to produce the trussed rafter.

5. A method as claimed in claim 2 wherein said codes relate to the required strength of the timber members used to produce the trussed rafter.

6. A method as claimed in claim 2 wherein said codes are used to select or reject timber members to be used to produce the trussed rafter.

7. A method as claimed in claim 1 wherein said affixing and said cutting are carried out using a combined automatic device for performing said affixing and cutting and said timber members are moved lengthwise through said combined automatic device.

8. A method as claimed in claim 1 wherein said affixing and cutting are carried out using an automatic device and data relating to the design of the trussed rafter is automatically fed to said device.

9. A method as claimed in claim 8 wherein said data includes cutting data.

10. A method as claimed in claim 8 wherein said data includes nail plate positioning data.

11. A method as claimed in claim 8 wherein said data includes marking data for marking said timber members.

12. A method for the production of a trussed rafter wherein timber members are assembled together to form the trussed rafter, said method comprising assembling timber members on a level surface including measuring lines and positioning guide elements in accordance with the dimensions of the trussed rafter to be produced, and pre-affixing nail plates to a plurality of the timber members with an accuracy which enables checking, during the assembly of the timber members, of the accuracy and quality of the assembly of timber members into joints used in forming the trussed rafter.

13. A method as claimed in claim 12 wherein nail plates are pre-affixed to the undersides of said timber members.

14. A method as claimed in claim 13 wherein nail plates are also affixed to upper sides of the timber members and displacement between the nail plates affixed to the upper sides and undersides of the timber members is checked to determine the accuracy of plate positioning and the quality of the trussed rafter produced.

15. A method as claimed in claim 12 wherein at least one joint of the trussed rafter is made with a gap therein so as to facilitate assembling and fitting of diagonals against chord members despite the presence of slight variations in diagonal length and chord width.

16. A method as claimed in claim 12 wherein the trussed rafter includes at least one curved chord member and curvature of said curved chord member is produced at least in part by embossing of diagonals forming a joint with said curved chord member.

17. A method as claimed in claim 12 wherein pressing of nail plates into the timber members is completed at an assembly station using a hammering tool.

* * * * *